US010590617B2

(12) United States Patent
Vruwink

(10) Patent No.: US 10,590,617 B2
(45) Date of Patent: Mar. 17, 2020

(54) TRAIL GROOMING METHOD AND APPARATUS

(71) Applicant: Bruce Vruwink, Lake Lillian, MN (US)

(72) Inventor: Bruce Vruwink, Lake Lillian, MN (US)

( * ) Notice: Subject to any disclaimer, the term of this patent is extended or adjusted under 35 U.S.C. 154(b) by 0 days.

(21) Appl. No.: 15/822,134

(22) Filed: Nov. 25, 2017

(65) Prior Publication Data

US 2019/0161928 A1 May 30, 2019

(51) Int. Cl.
*E01H 4/00* (2006.01)
*E01H 4/02* (2006.01)

(52) U.S. Cl.
CPC *E01H 4/00* (2013.01); *E01H 4/02* (2013.01)

(58) Field of Classification Search
CPC ..... E01H 4/00; E01H 4/02
USPC ..... 37/219, 222
See application file for complete search history.

(56) References Cited

U.S. PATENT DOCUMENTS 3,739,859 A * 6/1973 White ..... E01H 4/00 172/145
4,056,328 A * 11/1977 Maxey ..... E01H 4/00 172/787
4,057,916 A * 11/1977 Roemer ..... E01H 4/02 172/393
4,244,662 A * 1/1981 Olson ..... E01H 4/02 172/780
4,271,612 A * 6/1981 Mellingen ..... E01H 4/02 172/188
4,523,398 A * 6/1985 Scheibel ..... E01H 4/02 172/140

* cited by examiner

*Primary Examiner* — Robert E Pezzuto
*Assistant Examiner* — Joel F. Mitchell
(74) *Attorney, Agent, or Firm* — Robert S. Smith

(57) ABSTRACT

Apparatus for hardening the surface of a snow and ice covered trail which includes apparatus for travel over the snow and/or ice covered terrain that includes means to remove entrained air from snow and/or ice particles proximate to the apparatus; means for redistribution of the dispersed snow and ice laterally and axially with respect to the apparatus incident to movement of the apparatus after dispersing has occurred; and means for compacting snow and ice redistributed in the means for redistributing to increase the hardness of the snow and ice that has been redistributed.

12 Claims, 14 Drawing Sheets

TRAIL GROOMING METHOD AND APPARATUS

TECHNICAL FIELD

The present invention is generally directed to leveling, compacting and hardening to groom a snow-covered trail. "Trail grooming" is the process of producing a smooth surface of snow with a uniform high density using mechanical equipment. The grooming process is necessary both initially after a snow fall as well as subsequently due to weather conditions and the impact of traffic over a previously groomed surface in addition to, for example, water movement and timber operations.

A primary application is to prepare a trail for snow mobiles, skiers including cross country skiers, hikers, fat tire bicycles, aircraft landing and takeoff as well as others where it is desired to provide a planar, level compacted snow surface. The term fat tire bikes will be understood to refer large-tire bikes originally intended to pedal in snow and which may have tires that are more than 4" wide.

BACKGROUND OF THE INVENTION

Although the description herein will refer to in some cases specifically to snowmobiling in describing the specifics of the construction and use of the apparatus, it will be understood that the present invention has utility for each of the above applications. A snowmobiler's safety and enjoyment, for example, is greatly enhanced when a smooth, even layer of snow covers the trail they have chosen to ride.

Downhill skiers prefer soft, fluffy snow. Snowmobilers, fat-tire bicyclers, cross country skiers, aircraft (either on wheels or skis) and others traversing snow generally need a smooth, hard, dense surface. The hardness of ice is ideal, but the texture of snow is also needed for traction.

Trail grooming is important to snowmobilers because it has a very fundamental impact upon the enjoyment of their ride. Consequently, the general interest in good trail grooming is high throughout the snowmobiling community including businesses that cater to snowmobilers. At the same time, however, the actions of and the equipment used by snowmobile riders often relishing fast starts or stops, powering through curves, carbide runners, paddle tracks, and powerful engines can combine to have great impact on the conditions of snowmobile trails and can essentially destroy them very quickly. Trail grooming is typically the single greatest expense facing the operation of a snowmobile trail system, both in terms of capital costs to purchase expensive equipment as well as for the ongoing costs of operating and maintaining that equipment in harsh winter conditions. In many areas, trail grooming is often the primary focus of a snowmobile club or association's activities. It can account for as much as 50% to 75% of total expenditures for agency or association operated snowmobile programs. Thus, it is big business.

Snowmobile trail grooming equipment shares a common history with tracked vehicles originally developed for Antarctic travel and for the alpine ski industry. However, in the mid-1980's a number of changes began to evolve in snowmobile trail grooming tractors and drags that have greatly increased the effectiveness of today's snowmobile grooming equipment. While there is still some crossover today between alpine ski and snowmobile trail grooming equipment, snowmobile trail grooming equipment has evolved to be a specialty product that stands on its own.

Typical grooming tractors have a primary purpose is to provide the power to pull an implement (drag), power a tiller, or carry a compactor bar across the top of the snow. It may also be used to carry a front blade. Some areas also use farm tractors equipped with a track conversion to pull a dragged grooming apparatus. The actual work of grooming the snow on the trail bed is performed by a front blade used in conjunction with implements like a drag or tiller that are either towed or carried behind the tractor. A grooming drag is called a "planer" or a "surfacer" by some manufacturers.

A growing number of snowmobiles are operating on snowmobile trails today, which drives an increasing need for smooth trails that can keep traffic moving safely. This makes it necessary to optimize the use of personnel and equipment involved with trail grooming. Increased operational costs have also necessitated tighter controls on grooming operations to maximize the effectiveness of expenditures.

From the above, it is therefore seen that there exists a need in the art to overcome the deficiencies and limitations described herein and above.

SUMMARY OF THE INVENTION

Accordingly, it is an object of the present invention to facilitate trail grooming efficiently and effectively.

It is another object of the present invention to facilitate the formation of planar, level, hard, compacted snow to facilitate traversing.

The use of groomed trails by snowmobiles creates moguls, ridges, and ruts. Use of groomed trails by bicycles tends to create ruts and grooves. Cross country skiers desire "formed grooves" that "wear out" with use to guide the skis thru the trail and across the terrain. Because the moguls, ridges and ruts has had much of the entrained air removed they tend to freeze up hard and in undesirable profiles. It is an object of the present invention to return the disturbed snow to a smooth, hard, dense surface desirable by future users.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all such objects are present as essential features, either individually or collectively, in the most general embodiment of the present invention or in any of its more specific embodiments.

The shortcomings of the prior art are overcome and additional advantages are provided through a method for hardening the surface of a snow and/or ice covered trail which includes providing apparatus for travel over a snow and/or ice covered terrain; providing the capability in the apparatus for dispersing the snow and/or ice to remove entrained air from snow and/or ice particles and; providing the capability in the apparatus for redistribution of the dispersed snow and/or ice laterally and axially incident to movement of the apparatus after dispersing has occurred; providing the capability in the apparatus for compacting snow and/or ice for compacting the snow and/or ice; dispersing snow/or ice to remove entrained air from snow and/or ice particles proximate to the apparatus; redistributing snow and/or ice dispersed, in the dispersing step, axially and laterally incident to movement of the apparatus after the dispersing step; and compacting snow and/or ice redistributed in the redistributing step to increase hardness of the snow and/or ice that has been redistributed.

In another aspect, the present invention includes apparatus for hardening the surface of a snow and/or ice covered trail which includes apparatus for travel over a snow and/or ice covered terrain that includes means to remove entrained air from snow and/or ice particles proximate to the apparatus; means for redistribution of the dispersed snow and/or ice laterally and axially with respect to the apparatus incident to movement of the apparatus after dispersing has occurred; and means for compacting snow and/or ice redistributed by the means for redistributing to increase the hardness of the snow and/or ice that has been redistributed.

In some embodiments of the apparatus the means to remove entrained air from particles snow/ice is a flail drum. Other forms of the invention include means for removing entrained air from particles of snow/ice is an elongated auger that urges material engaging the axial extremities thereof toward the midpoint of the auger. The periphery of the auger may be manufactured of carbide, have carbide teeth, have a hardened surface provided by heat, mechanical means or welding.

The apparatus may be a trailer. The means for redistribution of the dispersed snow and/or ice laterally and axially with respect to the apparatus incident to movement of the apparatus includes may include a grader blade. The grader blade may be substantially planar and pivotally mounted about an axis proximate to the top thereof. In addition, the grader blade may be biased by the weight thereof to a vertical position. In some embodiments the grader blade is disposed intermediate the means to remove entrained air from snow and/or ice particles proximate to the apparatus and the means for compacting snow and/or ice redistributed in the redistributing step to increase the hardness of the snow and/or ice that has been redistributed.

The means for compacting snow and/or ice redistributed in the redistributing step to increase the hardness of the snow and/or ice that has been redistributed may be a plate compactor which may be electrically, hydraulically driven or driven from a power take off shaft. The plate compactor may include at least one fin having a body that is disposed in coplanar relationship with the direction of the apparatus.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description and the accompanying drawings in which:

DETAILED DESCRIPTION

Figure 1:
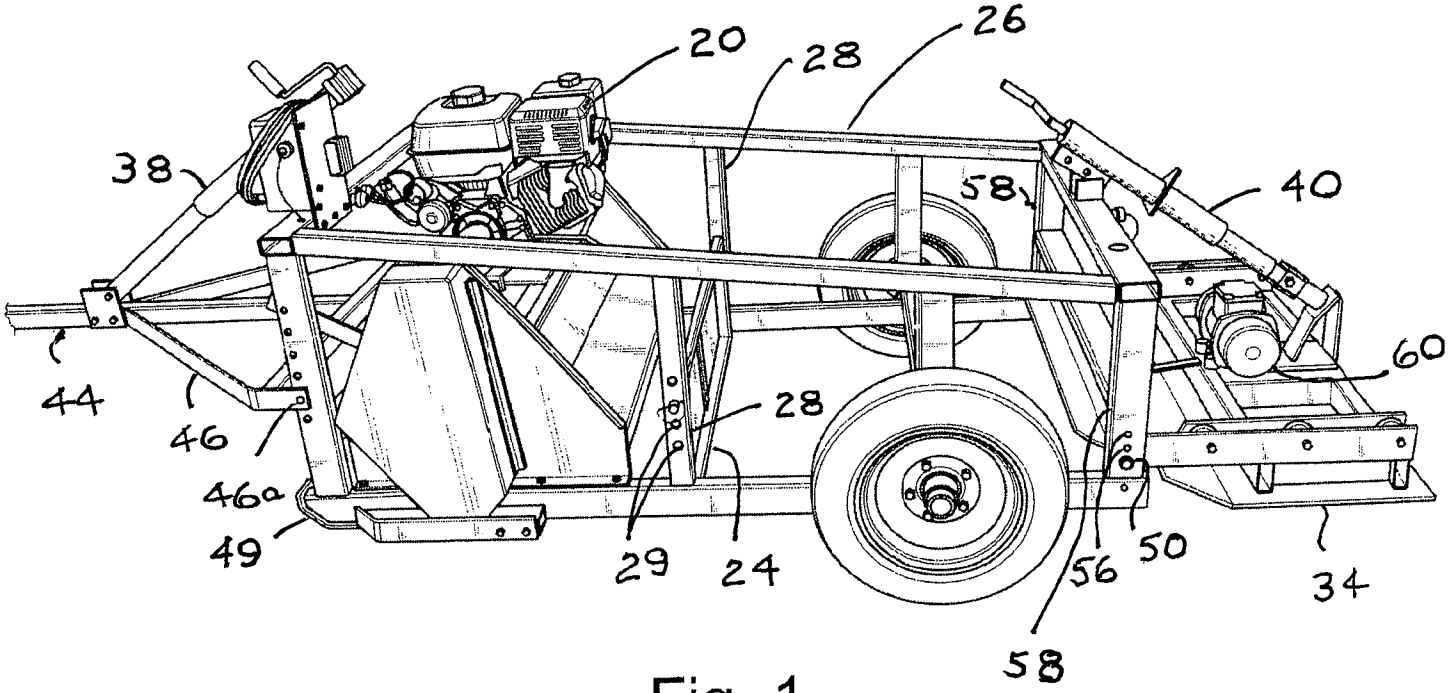
FIG. 1 is a left side view of one embodiment of the trail groomer in accordance with one form of the present invention.
Figure 2:
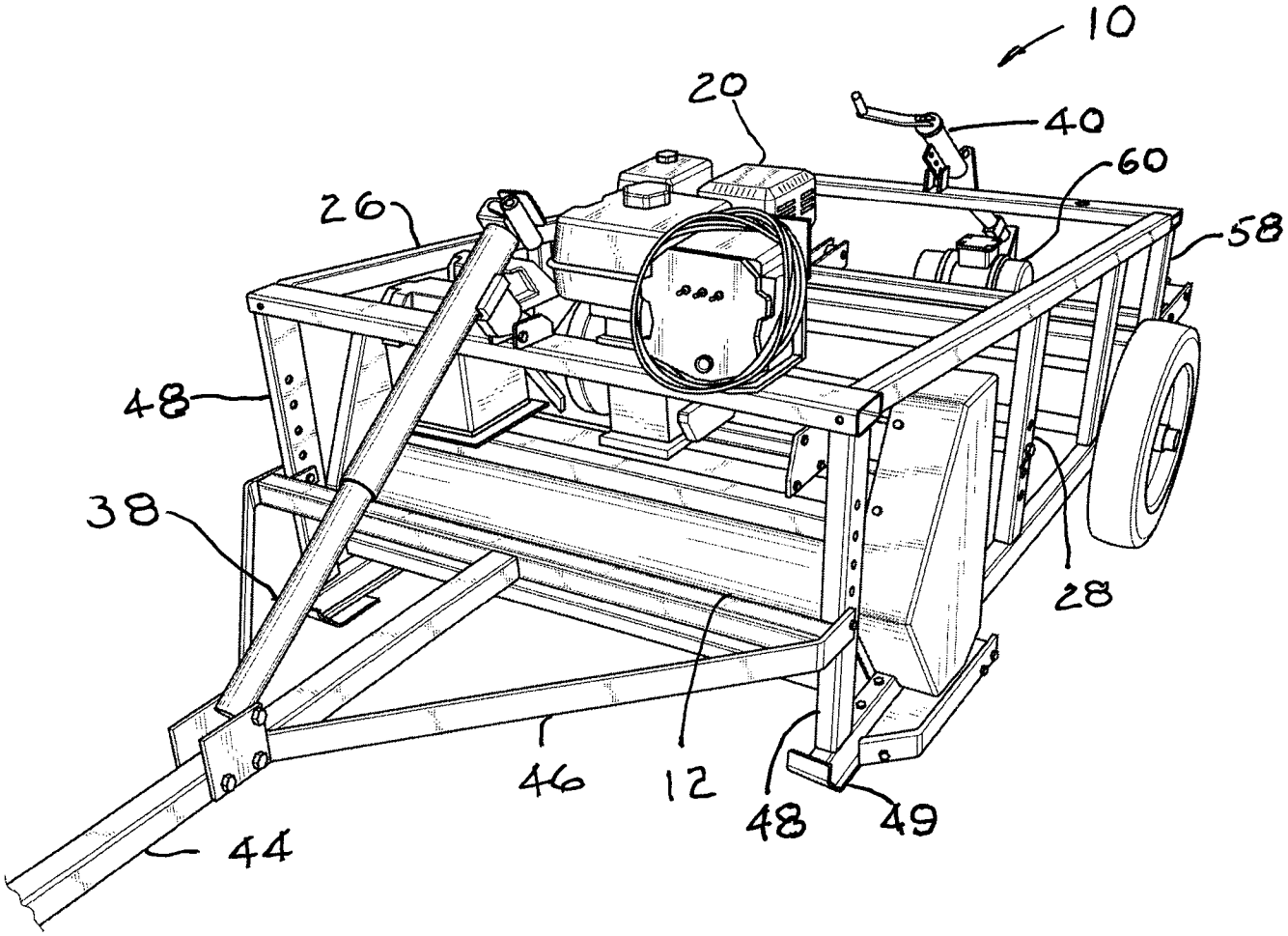
FIG. 2 is an isometric view of the apparatus shown in FIG. 1.
Figure 3:
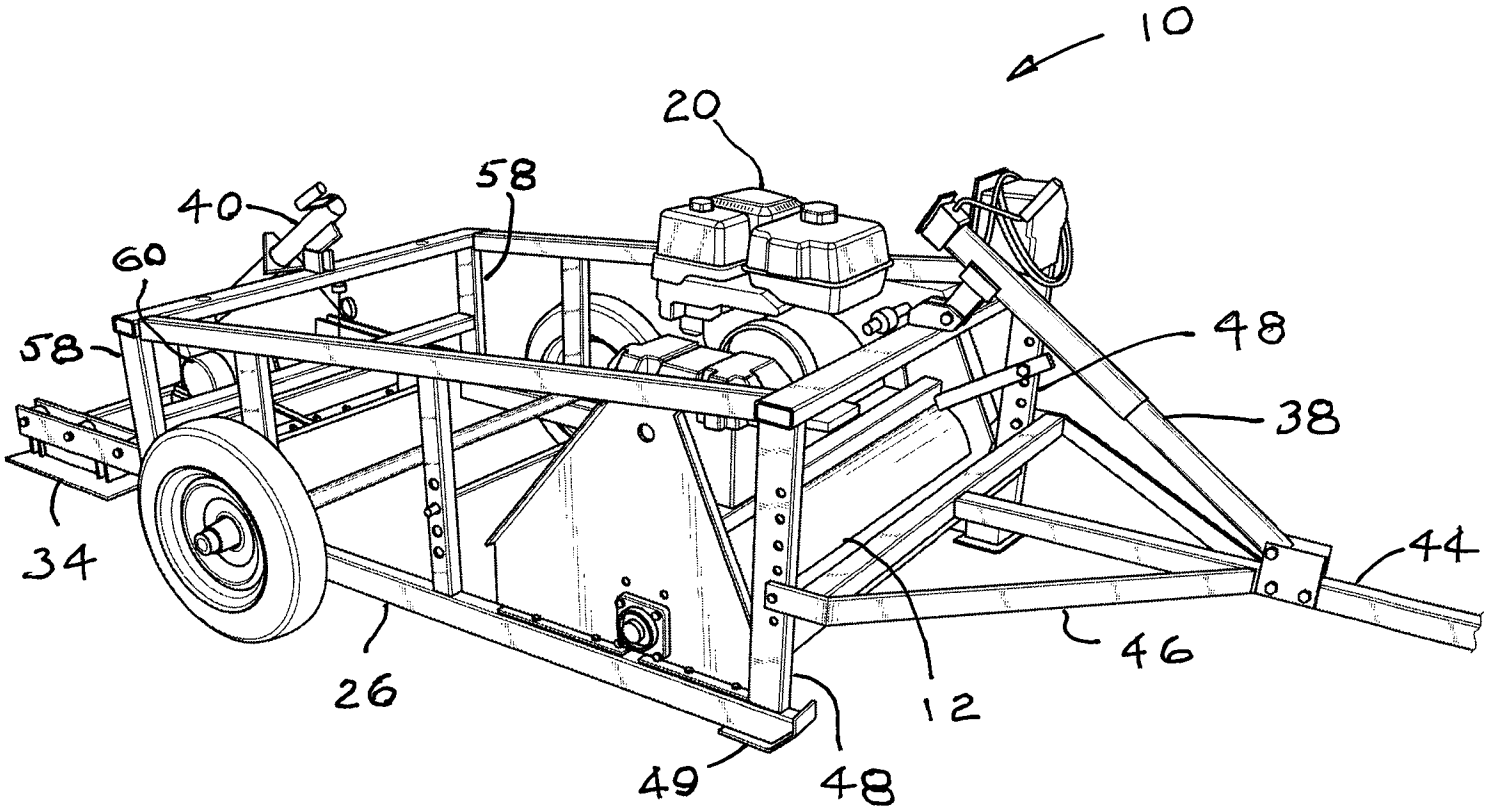
FIG. 3 is another isometric view of the apparatus shown in the FIG. 1.
Figure 4:
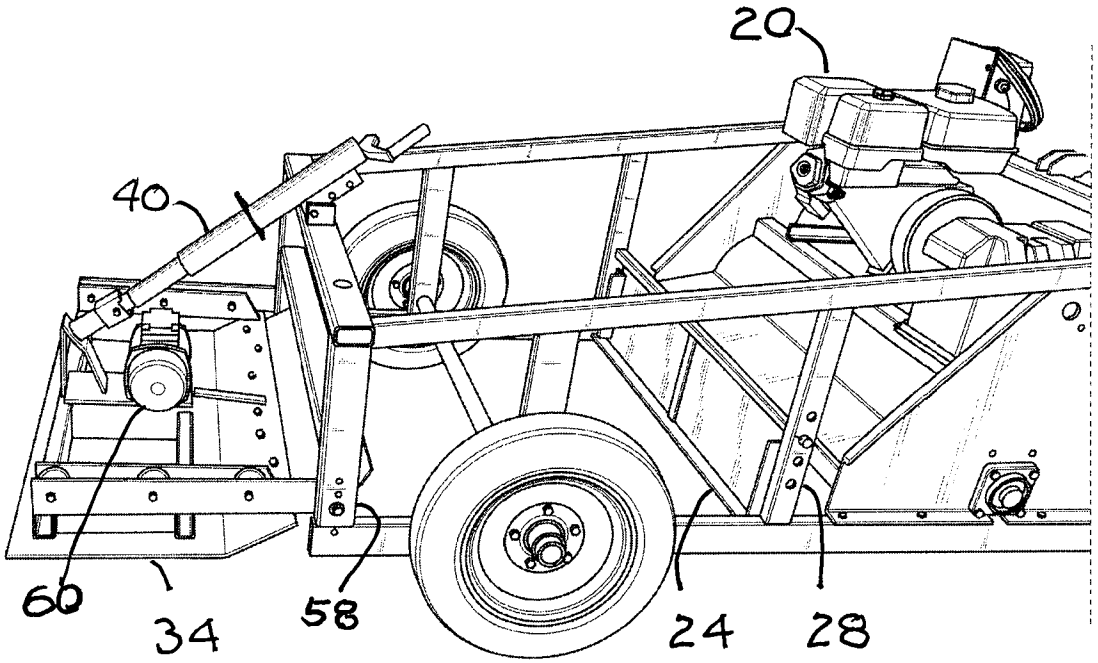
FIG. 4 is an isometric view showing in greater detail the packing apparatus section and the rear elevation jack screw that controls the angle of the vibratory plate.
Figure 5:
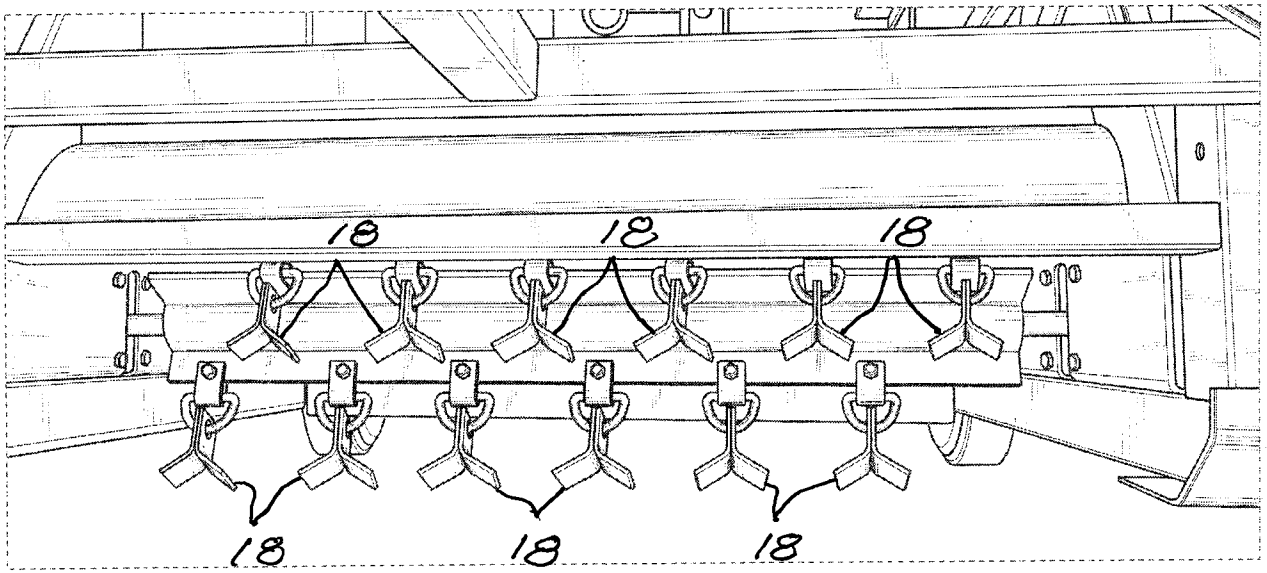
FIG. 5 is a view of the flail drum and the flail drum knives as viewed under (a) the front end and (b) the tow bar of the apparatus when looking toward the rear end.
Figure 6:
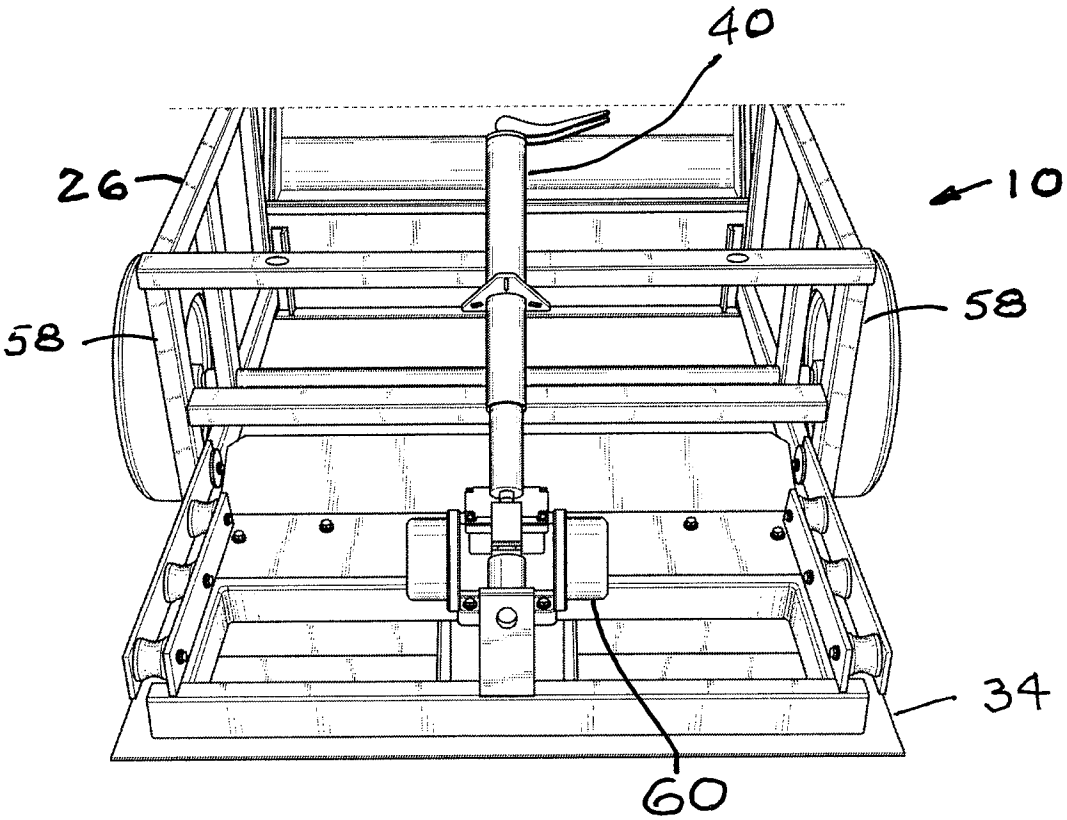
FIG. 6 is a rear isometric view showing the packing apparatus section and the rear elevation jack screw that controls the angle of the vibratory plate.
Figure 7:
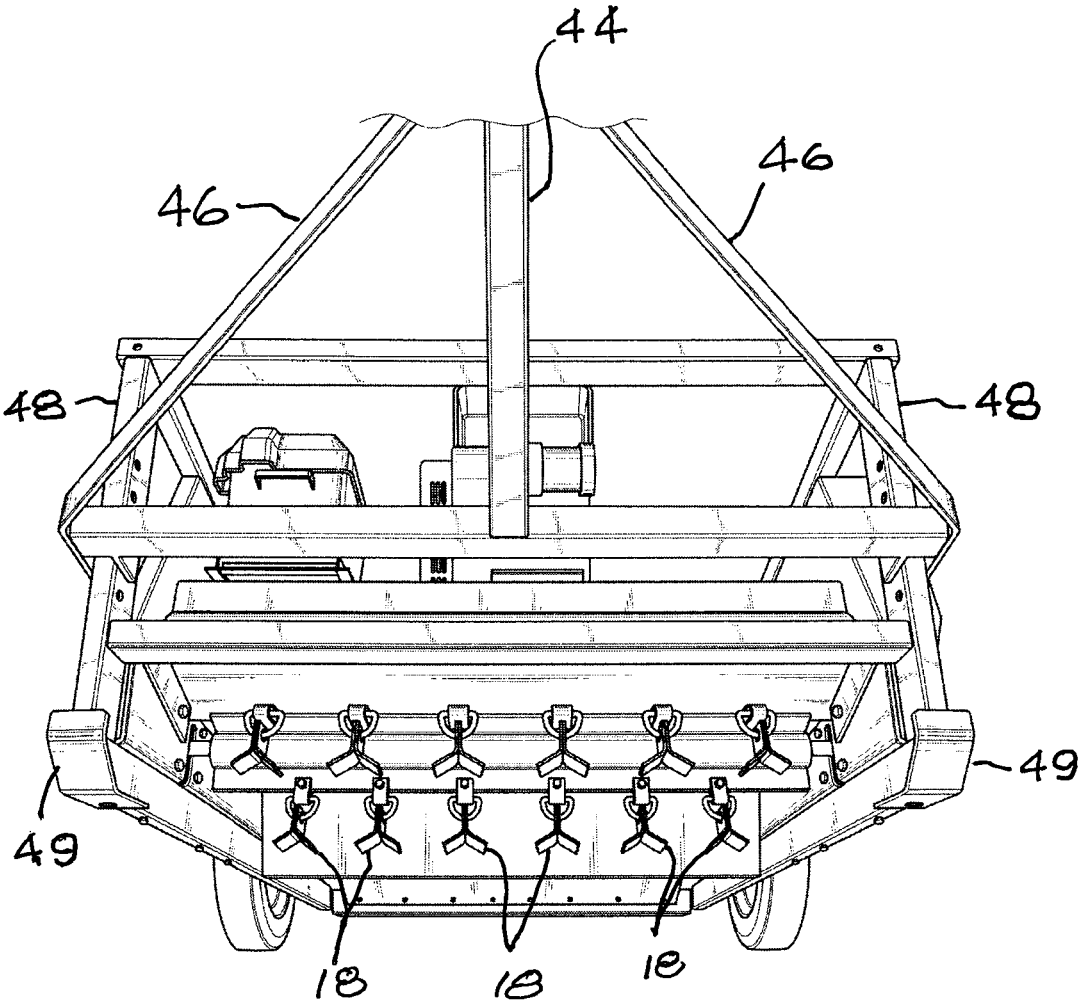
FIG. 7 is a view of the flail drum and the flail drum knives as viewed under (a) the front end and (b) the tow bar of the apparatus when looking toward the rear end.
Figure 8:
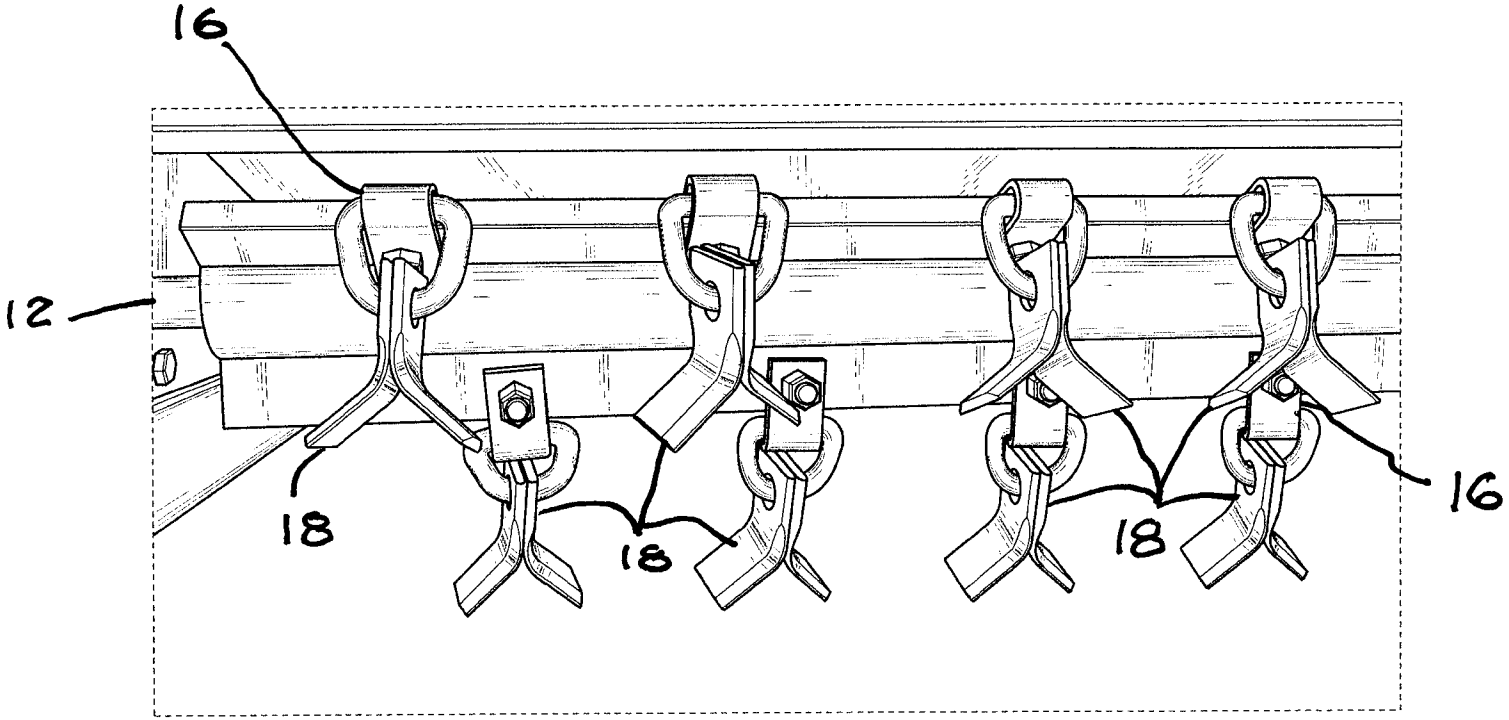
FIG. 8 is a view to an enlarged scale of the flail drum of the flail drum knives.
Figure 9:
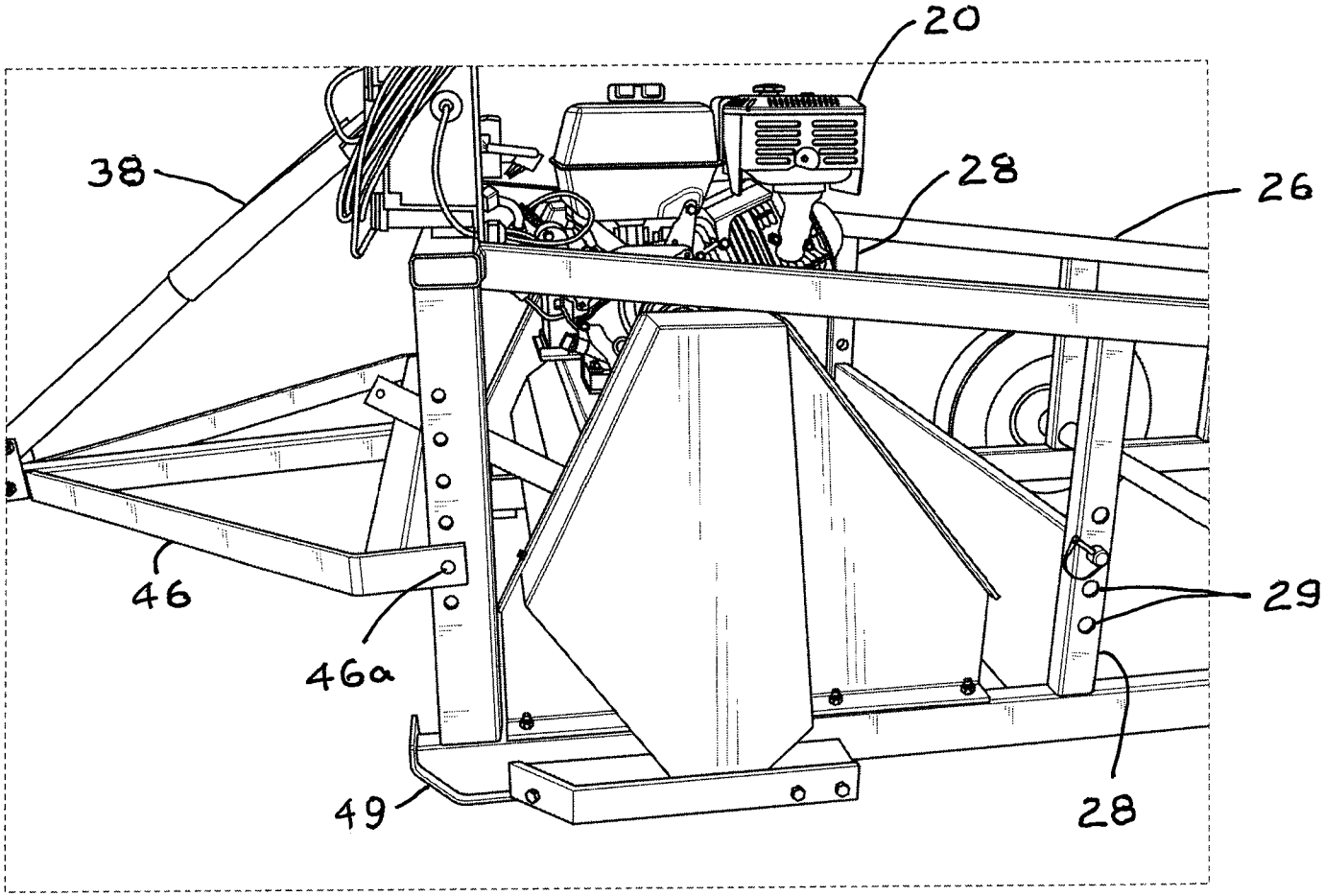
FIG. 9 is a side view of the mechanical agitator section at the front end of the apparatus.

The width of the desired trail required is dependent on the ultimate application. Fat tire bike trails are typically 20-40 inches wide. Trails for cross-country skiing extending through wooded areas are typically approximately 3-8 feet wide. Trails for snowmobiles are typically 8 to 10 feet wide. Still other dimensions are typical for other applications. Accordingly, the sizing of the apparatus will vary to maximize utility for grooming a specific trail.

One embodiment of the present invention is a towed wheeled vehicle 10. Other embodiments may include motive power with wheels or tracks. Some embodiments may be a sled with or without motive power. In each case the apparatus of the present invention produces a planar, level, hard, compacted snow to facilitate traversing.

The apparatus in accordance with some forms of the present invention includes three sequential stages:

1. Dispersal, agitation or grinding which may be achieved by a flail mechanism or an auger mechanism that feeds the snow inwardly to a second stage auger. The focus of this step is to remove entrained air from snow and ice particles in preparation for thereafter allowing freezing of the snow particles in a denser fashion without entrained air.

2. Redistribution is the process of lateral and axial movement of snow after the grinding process. More specifically, the lateral movement is perpendicular to the direction of travel of the vehicle and axial movement is aligned with the direction of travel of the vehicle in a process to make a planar, level, horizontal surface.

3. Compacting the snow which has been ground up and redistributed to thereby form a plane are horizontal surface that is very dense. Most embodiments of the present invention utilize a vibrating packer to further enhance the snow density to promote freezing/setting up with a very hard composition thus allowing vehicles/skiers to easily traverse the surface of the snow trail as well as producing a surface that is minimally impacted by that traverse.

The dispersal, agitation or grinding function of the apparatus 10 may be achieved in a variety of approaches. A first option utilizes a horizontal axis rotating flail drum 12 can be used to "beat" the air out of the snow and achieve uniform particle size. The term "flail drum" as well as the construction and operation thereof will be better understood by reference to U.S. Pat. Nos. 5,148,844; 8,099,936; 5,322,104; and 4,023,604 and US published patent application PCT/US2017/020784 which are incorporated by reference. Such apparatus has been used, for example, for delimbing and/or debarking small trees and logs, clearing minefields, and grass or brush cutting machines. In one embodiment of the present invention a rotor 14 has three rows of flail mounting ears 16 extending in axially extending rows disposed at 60° about the circumferential extent of the cylindrical body of the rotor 14. (Other embodiments may have rows disposed at 180° or 90° about the circumferential extent of the cylindrical body of the rotor 14.) In a typical embodiment the flails 18 may be either be the "paddle" type or the "swing knife" type. The flails 18 or knives are composed of hardened material to allow the removal/grinding of hard snow or ice. A gasoline engine 20 drives the flail drum 12 in the illustrated embodiment. Other embodiments may use a power take off shaft, electric motor or hydraulic motor.

Figure 13:
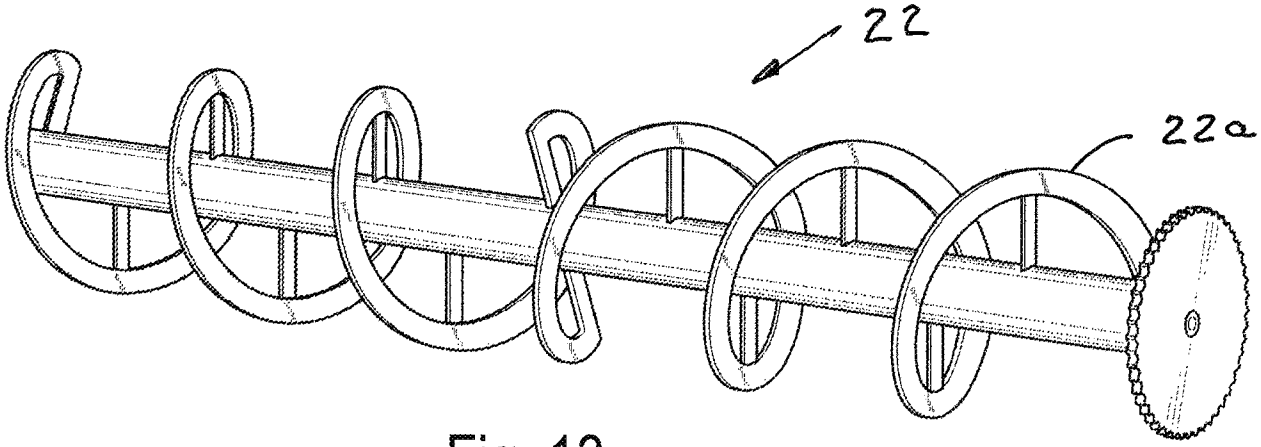
FIG. 13 is a view of an auger that directs snow and ice that engages the side of the auger to the center/midpoint of the auger for distribution.

In an alternative embodiment dispersal, agitation or grinding is achieved a horizontal rotating auger 22 having a drum around part of the circumference (not shown) and an open center. The auger 22 has left and right axial sections that differ in shape. Each axial section has a helical form that feeds snow to the center of the auger 22 which is thereafter distributed from there either by a duct or by a second stage blower. The construction of the auger is show in FIG. 13. Apparatus of this general type utilizing an auger that feeds a blower or impeller is shown and described in US published patent application 2007/0084091 as well as U.S. Pat. No. 5,209,003 which are incorporated by reference. Such apparatus utilizes an auger having similar shape and function. In some embodiments of the present invention the periphery 22*a* of the auger 22 may be carbide, carbide teeth, or surface treatment including hard surface welding to facilitate breaking up ice.

The "first stage" grinder action of the present invention removes entrained air in the snow, grinds up ice and crusty snow to create a medium that is capable of being "worked" or leveled. The removal of entrained air creates a medium whereby the water including snow will "freeze up/set up" harder. "Freeze up" generally requires 4-8 hours (depending on ambient temperature) to achieve. Grooming at night in the absence of traffic is preferable to allow the smooth trail to freeze hard prior to being subjected to use/traffic.

The movement of the snow to the center of the rotating auger 22 removes entrained air from the snow and provides a denser product to compact and freeze. The auger 22 is optionally fitted with carbide teeth around the periphery of the helical blade therof to provide the ability to remove/grind hard snow or ice that may be encountered.

Figure 10:
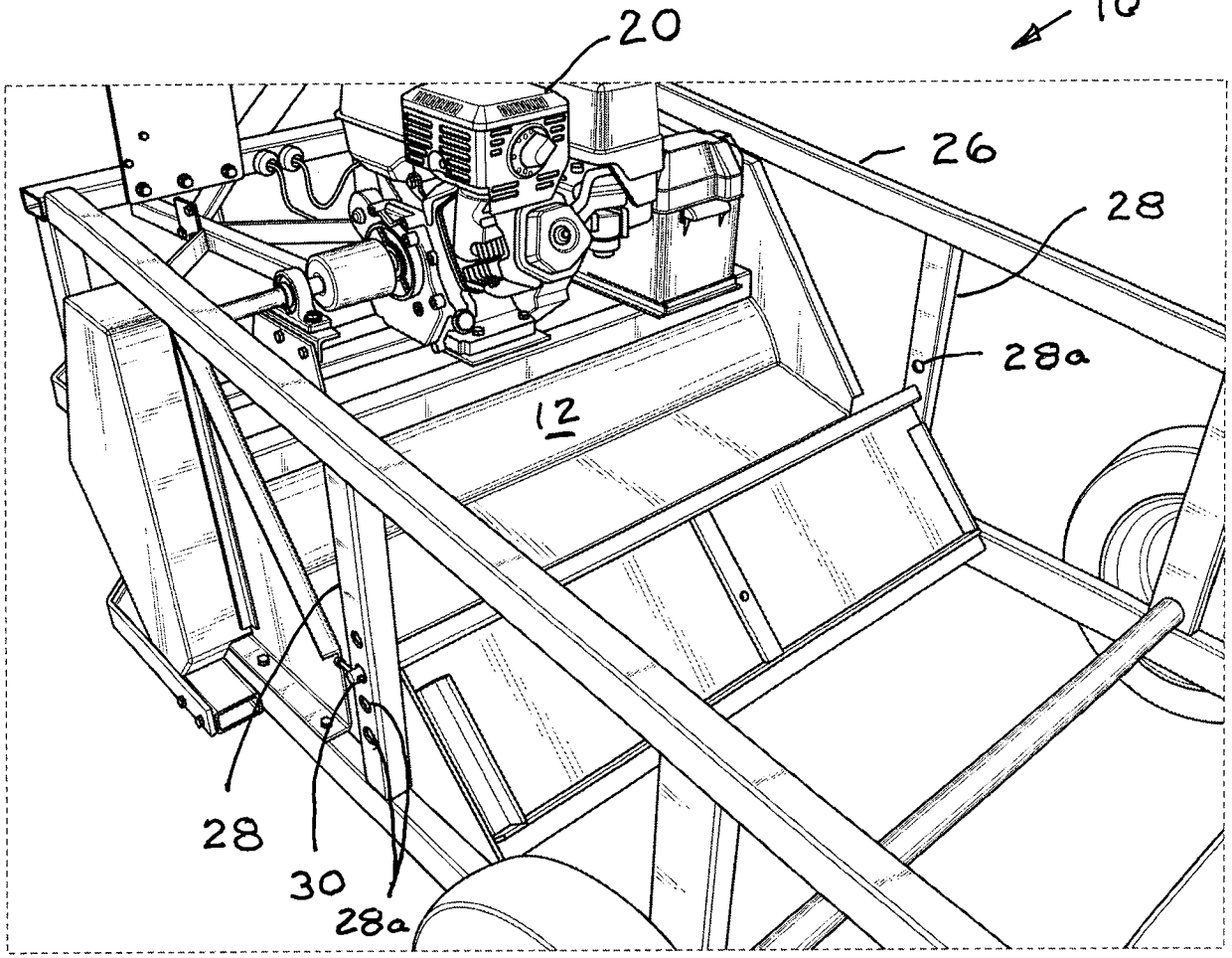
FIG. 10 is an isometric view showing a pivotally mounted flap used to level snow below the apparatus and more particularly shows the flap position when functioning to grade the show.
Figure 11:
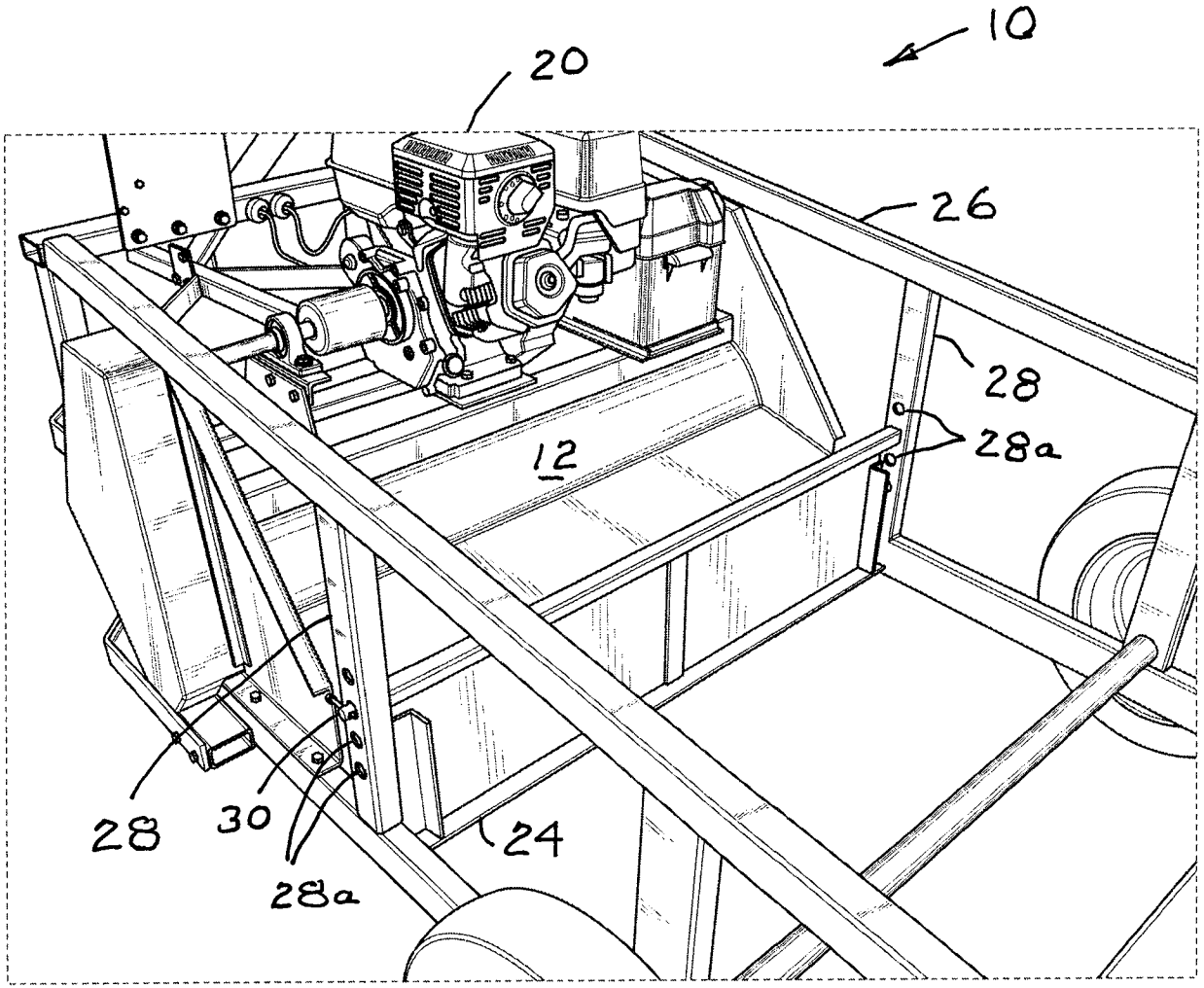
FIG. 11 is an isometric view showing the pivotally mounted flap used to level snow below the apparatus and more particularly shows the flap position when not functioning to grade the show.
Figure 12:
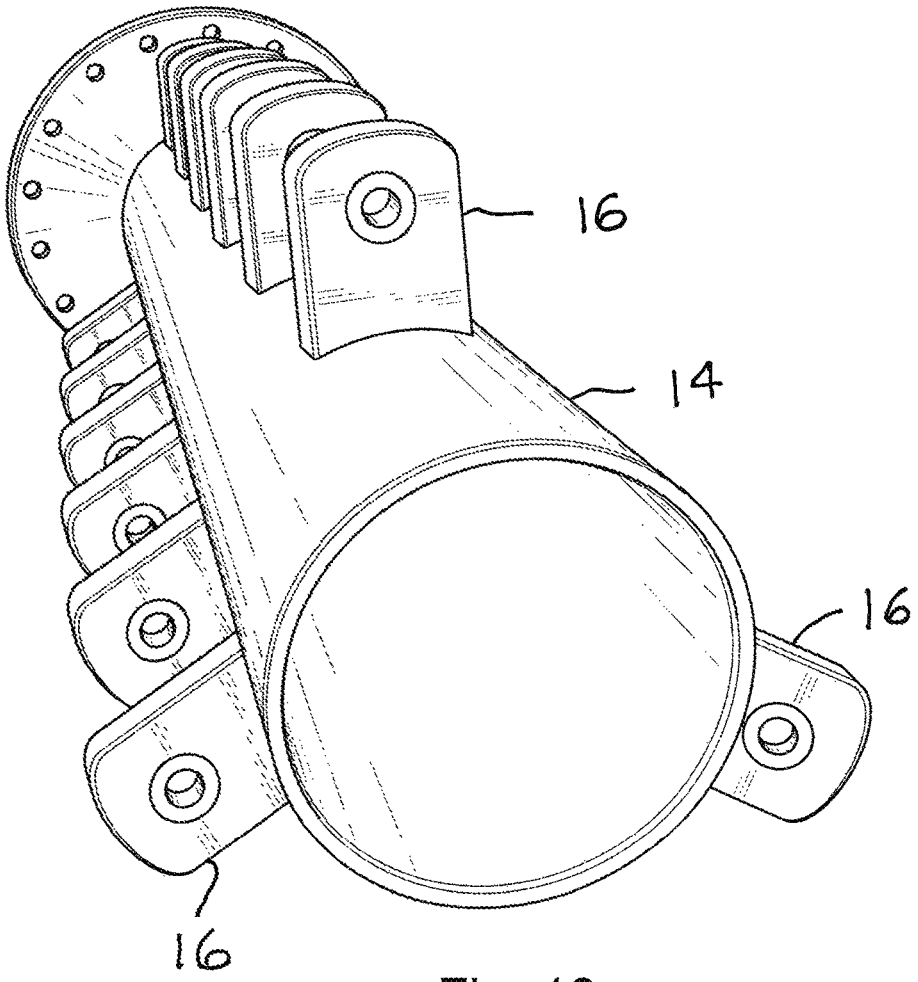
FIG. 12 is an isometric view of one embodiment of the rotor for the flail drum illustrating the mounting structure for rows knives disposed at circumferential intervals of 60 degrees.

A preferred embodiment of the present invention achieves the redistribution stage with a grader blade 24. More particularly, the apparatus 10 includes the frame 26 that includes opposed columns 28. Each of the opposed columns 28 (positioned respectively on the left and right sides of the apparatus 10). Each column 28 includes a plurality of vertically spaced holes 28*a* dimensioned and configured for receiving opposed outwardly extending pins 30 (one visible) that are part of the grader blade 24. Accordingly, the weight of the grader blade 24 biases the angular position of the grader blade 24 with respect to an axis of rotation defined by pins 30 and holes 28*a*. More particularly, the grader blade 24 is biased by gravity to a substantially vertical position as shown in FIG. 11. When the grader blade 24 is in operation the forces against the grader blade 24 will cause it to move to a position such as that shown in FIG. 10. It will be understood that the plurality of vertically spaced holes in the columns 28 permits user adjustment of the engagement of the grader blade 24 with snow disposed under the apparatus 10. The engagement with the snow determines the amount of redistribution that is achieved by the grader blade 24. Accordingly, the grader blades 24 causes the snow under the apparatus to be evenly distributed in a transverse manner after the grinding process. More specifically, the lateral movement is perpendicular to the direction of travel of the vehicle in a process to make a planar, level, horizontal surface.

A snowmobile travelling at high speed will transmit sizeable forces on the snow beneath the tracks thereof. These forces will cause considerable lateral movement of the snow resulting in "ruts" in the traffic lanes. On curved parts of the trail the snow will be displaced to a position that is outboard with respect to the trail. In general, the sharper the curve, the greater the displacement of snow. Accordingly, the grooming apparatus for snowmobile applications is more demanding.

In contrast, bicycles will not cause as much lateral movement as snowmobiles simply because smaller forces are involved. Skiers produce even smaller forces. Accordingly, the grooming for bicycles and skiers will usually be achievable with a dispersal stage using a flail drum 12 and a grader blade 24 if the trail is less than 60" wide.

However, for typical trails that are wider including those that are 8-10 feet wide a more robust redistribution structure may be needed. As noted herein, snow has widely differing characteristics which impacts what specific apparatus is required. The blades 74 in one preferred embodiment are arranged with two blades at oblique angles to the direction of travel and angled to move the snow to the center of the trail. Most of the time the necessary movement of the snow is from the outside of the trail to the middle. The outboard ends of the blades are carried by the outside edge of the groomer and they will ordinarily not be over 50-60% of the width of the machine and typically be at least 40% the width of the groomer. Any surplus snow that is not distributed by a plurality of oblique grader blades is in some embodiments addressed by (1) a blade disposed at 90 degrees to direction of travel, (2) positioned behind the other blades and (3) dimensioned in width to adequately address the even distribution of the snow. Most environments will require the blade to be the full width of the machine.

Figure 14:
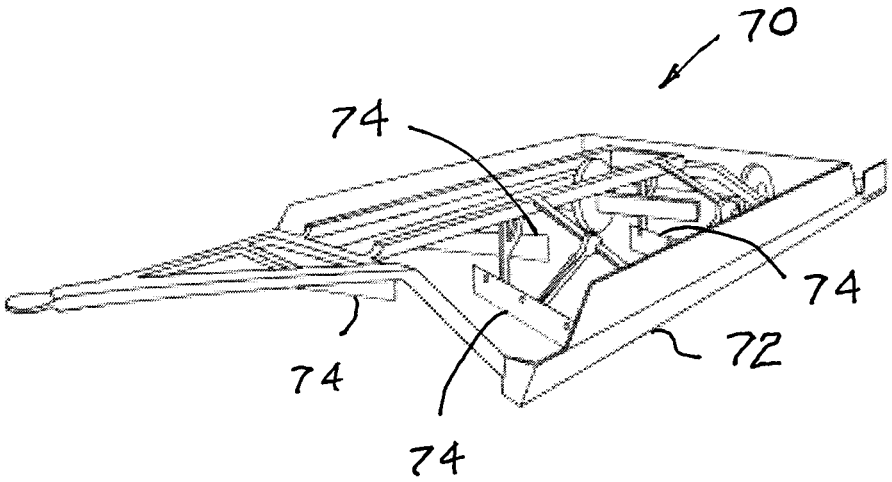
FIG. 14 is an isometric view of an alternative redistribution apparatus having application to grooming relatively wide trails.

More particularly, referring now to FIG. 14 there is shown an embodiment of the alternative redistribution stage 70 that replaces the grader blade 24. The redistribution stage 70 includes a generally rectangular concave frame 72 that supports a plurality of grader blades 74 that are obliquely disposed with respect to the direction of travel. More specifically, each grader blades 74 extends inwardly from the frame 72 with an included angle of less than 90°. Typically, each blade extends from the frame 72 beyond the centerline disposed intermediate the opposed sides of the frame 72. Furthermore, the blades 74 are disposed along the longitudinal extent of the frame 72 alternately from the left and right sides of the frame 72. Thus, as the redistribution stage 70 moves longitudinally over a trail snow may engage, for example, a grader blade 74 on the left side of the redistribution stage 70. Excess snow will pass around the inboard end of that grader blade 74 and thereafter engage a grader blade 74 on the right side of the redistribution stage 70. In this manner the sequential sweeping action of the respective grader blades 74 promotes a satisfactory redistribution.

This will move snow laterally and establish a transversely flat surface prior to being packed with the 3rd stage vibrating plate. The vibrating plate will also act to some extent as a leveling device. Those skilled in the art will recognize that the apparatus and method of the present invention involves pulling thru and moving a tremendous amount of snow.

The compacting step after the snow is ground up and redistributed further contributes to the formation of a planar horizontal surface that is very dense. This function is achieved by third/rear member of the apparatus 10. It is a vibrating packer or plate compactor 34 that extends across the width of the apparatus 10 to level out and smooth the snow and pack the snow into a super dense medium prior to re-freezing.

Examples of known plate compactors include those shown in U.S. Pat. No. 5,320,448 (showing a gasoline engine driven compactor); Published US Patent Application 2009/0145309 (showing an electric drive pate compactor) and U.S. Pat. No. 4,771,645 (showing a vibrating assembly having two counter-rotating eccentrics) and Published US Patent Application 2017/0009407 (describing a hydraulically operated compactor). One of the preferred embodiments of the present invention utilizes a hydraulic motor to rotate a shaft having eccentric weights to produce the desired vibration. The assembly that includes the hydraulic motor as well as the eccentric weights will be referred to herein as vibration assembly 60. Other embodiments of the present invention may be powered driven in a similar manner.

Plate compactors are often used in the building construction field to compress some types of soil and gravel for construction projects that require a stable subsurface. The core of the machine is a heavy, flat plate that rests on the ground when the machine is off. The plate is driven or vibrated up and down with either gasoline or diesel engines.

In the illustrated embodiment of the apparatus 10 the vibrating packer 34 is electrically operated. Electric power is supplied from a generator on the towing vehicle (not shown). The vibrating member will in various embodiments be selected from the group consisting of a smooth plate packer, a textured plate packer, or a smooth or textured rolling drum required for the specific terrain, environment and the particular type of trail desired. In other embodiments of the present invention the vibrating packer 34 may be powered by a hydraulic motor, a power takeoff shaft, or other apparatus.

The vibrating packer 34 includes, in some embodiments, vertical "fins" running front to rear to keep the machine aligned in the direction of travel. The utilization of such fins is dependent on the ambient conditions and the size of the apparatus. The size of the apparatus is of course dependent on the size of the trail being groomed. Particularly for very large grooming apparatus, vertical fins may extend from the vibratory plate to facilitate forming of a rectilinear trail and to avoid undesired deviations from a desired path. An example of such fins is shown in U.S. Pat. No. 4,165,091 describes a snowboard that utilizes a central fin 36 on its underside which will help stabilize the board when used for snow surfing. That patent is incorporated by reference herein.

The apparatus in accordance with the present invention utilizes a front jackscrew 38 and a rear jackscrew 40. (Other embodiments may use electric jackscrews or hydraulic cylinders controlled from the towing vehicle.) The front jackscrew is used to raise and lower the flail drum 12. This adjustment determines the engagement of the flail drum 12 with the snow. It is desirable to have this adjustability because, for applications where the apparatus 10 must complete substantial grooming, it is desirable to adjust the engagement of the flail for maximum engagement. For applications where the apparatus 10 is used only for a touchup and only minor grooming is desirable, it is desirable to adjust the engagement of the flail drum to a minimal amount of engagement with the snow. For example, the engagement might only be for the top 1 inch of the surface for a touch up grooming operation.

As best seen in FIG. 1 the front tow bar 44 is connected, in part by a yoke 46 to the frame 26. More particularly, the yoke 46 includes inwardly facing pins that cooperate with a selected pair of coaxial holes of a set of vertically spaced holes in the vertical spaced columns 48 that are part of the frame 26 and disposed at the front end thereof. Sled runners 49 are fixed to the front lower extremity of the frame 26 to enable the apparatus 10 to slide over unusual obstacles in or under the snow.

The rear jackscrew 40 is used to adjust the angular orientation of the plate portion of the vibrating packer 34 that includes coaxial pins 50 that cooperate with a pair of coaxial holes 56 selected from a plurality of pairs of vertically spaced pairs of coaxial holes in the laterally spaced columns 58 disposed at opposed sides of the rear of the frame 26. Accordingly, the height of the vibrating packer 34 is adjustable.

The specifics of the construction of embodiments of the present invention for such diverse applications are dependent on, in part, on the type of trail; past, present and future temperature and humidity; altitude; grade slope; water content; the time of day; the depth of snow; the type of snow (fluffy powdery snow to very hard and thick ice); terrain (pristine and untouched by human disruption or may be substantially disrupted by human intervention); traffic volume and use patterns; prevailing winds; past present and future storms as well as avalanche or water crossing of the trail.

Typically, it is desirable that the trail formed in accordance with the present invention will be allowed to solidify before utilization in whatever manner intended. This waiting period ensures proper hardening of the trail surface.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. Apparatus for hardening the surface of a snow and ice covered trail which comprises:

means for movement of the apparatus over a snow and ice covered terrain that includes means to remove entrained air from snow and or ice particles proximate to said apparatus, said means to remove entrained air includes an elongated auger that feeds snow and ice from each axial extremity thereof toward the center thereof;

means for redistribution of the dispersed snow and ice laterally and axially with respect to the direction of movement of the apparatus after dispersing has occurred; and means for compacting snow and ice redistributed by said means for redistributing to increase the hardness of the snow and ice that has been redistributed.

2. The apparatus as described in claim 1 wherein the periphery of said elongated auger is manufactured of carbide.

3. The apparatus as described in claim 1 wherein said apparatus is a trailer.

4. The apparatus as described in claim 1 wherein the means for redistribution of the dispersed snow and ice laterally and axially with respect to the direction of movement of the apparatus includes a grader blade.

5. The apparatus as described in claim 4 wherein said grader blade is substantially planar and pivotally mounted about an axis proximate to the top thereof.

6. The apparatus as in claim 5 wherein said grader blade is biased by the weight thereof to a vertical position.

7. The apparatus as described in claim 5 wherein said grader blade is disposed intermediate said means to remove entrained air from snow and ice particles and said means for compacting snow and ice.

8. The apparatus as described in claim 1 wherein said means for compacting snow and ice to increase the hardness of the snow and ice that has been redistributed is a plate compactor.

9. The apparatus as described in claim 8 wherein said plate compactor is hydraulically driven.

10. The apparatus as described in claim 8 wherein said plate compactor includes at least one fin having a body that is disposed in coplanar relationship with the direction of movement of said apparatus.

11. The apparatus as described in claim 1 wherein said means for redistribution of the dispersed snow and/or ice laterally and axially with respect to the direction of movement of said apparatus incident to movement of the apparatus after dispersing has occurred includes a plurality of scraper blades that are disposed in oblique relationship with respect to the direction of movement.

12. The apparatus as described in claim 11 wherein said plurality of scraper blades are disposed in spaced relationship along an axis that is parallel to the the direction of movement of the apparatus.

* * * * *